US006301817B1

(12) United States Patent
Hogue et al.

(10) Patent No.: US 6,301,817 B1
(45) **Date of Patent: *Oct. 16, 2001**

(54) LONG GUN STOCK

(76) Inventors: Aaron G. Hogue, 4480 Linne Rd., Paso Robles, CA (US) 93446; Patrick L. Hogue, 9170 Santa Lucia Rd., Atascadero, CA (US) 93422

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/749,034

(22) Filed: Nov. 14, 1996

(51) Int. Cl.[7] ..... F41C 23/18
(52) U.S. Cl. ..... 42/71.01; 42/75.03
(58) Field of Search ..... 42/71.01, 71.02, 42/73, 74, 75.03

(56) References Cited

U.S. PATENT DOCUMENTS

| | | | | |
|---|---|---|---|---|
| 2,753,642 | * | 7/1956 | Sullivan | 42/71.01 |
| 3,299,558 | * | 1/1967 | Karl | 42/71.01 |
| 3,926,866 | * | 12/1975 | Komatsu et al. | 180/89 |
| 4,504,604 | * | 3/1985 | Pilkington et al. | 523/167 |
| 4,512,101 | * | 4/1985 | Waterman, Jr. | 42/74 |
| 4,934,084 | * | 6/1990 | Thomas | 42/71.01 |
| 5,020,260 | * | 6/1991 | Houghton | 42/75.02 |
| 5,265,366 | * | 11/1993 | Thompson | 42/74 |
| 5,465,520 | * | 11/1995 | Cupp | 42/71.02 |

FOREIGN PATENT DOCUMENTS

| | | | | |
|---|---|---|---|---|
| 2017087 | * | 10/1971 | (DE) | 42/71.01 |
| 2677743 | * | 12/1992 | (FR) | 42/71.01 |

OTHER PUBLICATIONS

Brochure—"Fine Handgun Stocks" Hogue Gripus, Paso Robles, CA. pp. 1–10.

* cited by examiner

*Primary Examiner*—Stephen M. Johnson
(74) *Attorney, Agent, or Firm*—Charles C. Logan, II

(57) ABSTRACT

A strong, durable, lightweight long gun stock comprising a rigid insert molded of reinforced thermoplastic material together with a foaming agent. The insert is over-molded with a thermoplastic material which provides the stock with the desired surface characteristics. The insert is dimensioned with respect to its over-molded surfaces to be smaller than the finished stock and is designed to give maximum strength to the stock. The insert is shaped to promote the flow of the over-mold material and to minimize shrinking, swelling or distortion of the insert. The over-mold material may be a hard, un-foamed material or a thermoplastic elastomer. The hard un-foamed over-mold material mechanically bonds with the insert and provides the stock with an extremely smooth, hard outer surface. The thermoplastic elastomer over-mold material is compatible with the material of the insert and bonds both mechanically and chemically with the insert, providing the stock with a soft, quiet, non-slip surface.

16 Claims, 7 Drawing Sheets

LONG GUN STOCK

TECHNICAL FIELD

The invention relates to a stock for a long gun, and more particularly to such a stock comprising a molded, reinforced plastic insert over-molded with a material which provides the desired outer surface characteristics of the stock.

BACKGROUND ART

The invention is directed to improved stocks for long guns such as rifles, shotguns and the like. While not intended to be so limited, the invention will be described in its application to a rifle. It will be understood that the basic teachings of the present invention can be applied to stocks for other types of long guns.

Prior art workers have devised many types of rifle stocks to better hold and aim a rifle, to reduce recoil, and to improve the comfort and accuracy of a rifle. Heretofore, rifle stocks have been constructed from rigid materials such as wood or plastic. However, wood stocks are easily scratched and can be damaged by water and weather. Molded plastic stocks can be slippery and often have a poor finish due to foam filling. As a result, plastic stocks are frequently painted.

Another disadvantage of prior art molded plastic stocks lies in the fact that they produce a hollow, noisy sound when carried through brush or caused to contact some other object. This hollow sound is highly undesirable to hunters, law enforcement personnel, military snipers and the like. Finally, most rifles must be properly fit and bedded to conventional wood or synthetic stocks for maximum accuracy. This is usually a custom process that is sometimes difficult.

The present invention is based upon the discovery that a rifle stock, comprising an insert of reinforced thermoplastic material with an appropriate foaming agent, and an over-molded thermoplastic material which determines the characteristics of the stock's outer surface, can overcome the above-noted problems. When an un-foamed hard material is used as the over-mold material, an extremely hard stock is provided with an aesthetically pleasing, very smooth surface. When a thermoplastic elastomer (TPE) over-mold material is used, the stock is provided with a soft, comfortable, non-slip, and aesthetically attractive surface over the entirety of the stock. The thermoplastic elastomer also serves as a noise insulator which significantly reduces the noise of the stock when carried through brush and the like. The thermoplastic rubber material also reduces the action noise of the bolt which is highly desirable for hunting, police and military applications.

Rubberized elastomeric hand gun grips are old and well-known in the art. It will be understood, however, that rifles and hand guns are entirely different in both size and configuration. These differences pose many engineering and technical problems which had to be solved in order to produce the rifle stock of the present invention. These problems and their solution will be set forth hereinafter.

DISCLOSURE OF THE INVENTION

It is an object of the invention to provide a rifle stock which is both strong and durable, and at the same time is relatively lightweight.

It is an object of the invention to provide a stock with a finish superior to that which is possible to achieve in conventional rigid plastic stocks molded by conventional techniques. This is true of both the soft thermoplastic elastomer over-mold and the hard un-foamed material over-mold of the present invention.

It is an object of the present invention to provide a stock of exceptional aesthetic appearance.

It is an object of the invention to provide a stock which will allow for maximum accuracy by selectively providing adjustable means to free float or pressure bed the rifle barrel. The stock of the present invention may also be provided with hard bedding components strategically integrated into the stock.

It is an object of the present invention to provide a more comfortable and secure stock than is achievable with existing designs and conventional construction techniques.

It is an object of the present invention to provide a quiet stock which does not possess the noise problems with which conventional hard, synthetic, molded stocks are characterized.

Finally, it is an object of the invention to provide a cushioned rifle stock shaped to fit comfortably in the hands and arms of the user.

According to the invention there is provided a strong, durable, lightweight rifle stock. The stock comprises a rigid insert molded of reinforced plastic material, together with a foaming agent. The insert is over-molded with a thermoplastic material which provides the stock with the desired surface characteristics.

The insert is precisely dimensioned so that its over-molded areas are smaller than the finished stock. The insert is designed to give maximum strength to the stock and is shaped to promote the flow of the over-mold material to minimize joint and weld problems. The insert is designed to minimize shrinking, swelling or distortion of the insert, and to this end is provided with strategically located ribs and appropriate cored areas.

When the over-mold material is such as to provide a hard, un-foamed over-mold (such as nylon or the like), the over-mold material mechanically bonds with the insert and provides the stock with an extremely smooth, hard, aesthetically pleasing outer surface.

When thermoplastic material of the insert and the over-mold thermoplastic elastomer are both olefin based, the over-mold will bond both mechanically and chemically with the insert and will provide the stock with a soft, quiet, non-slip surface. The surface may be textured to further enhance the grip. Nevertheless, when the user relaxes his grip, the surface will allow manual mobility similar to that offered by a smooth stock.

DETAILED DESCRIPTION OF THE INVENTION

It will be understood by one skilled in the art that, for each type or model of long gun to which the stock of the present invention is to be applied, the finished stock, the insert and the molds must be appropriately designed in accordance with the teachings of the present invention.

Figure 1:
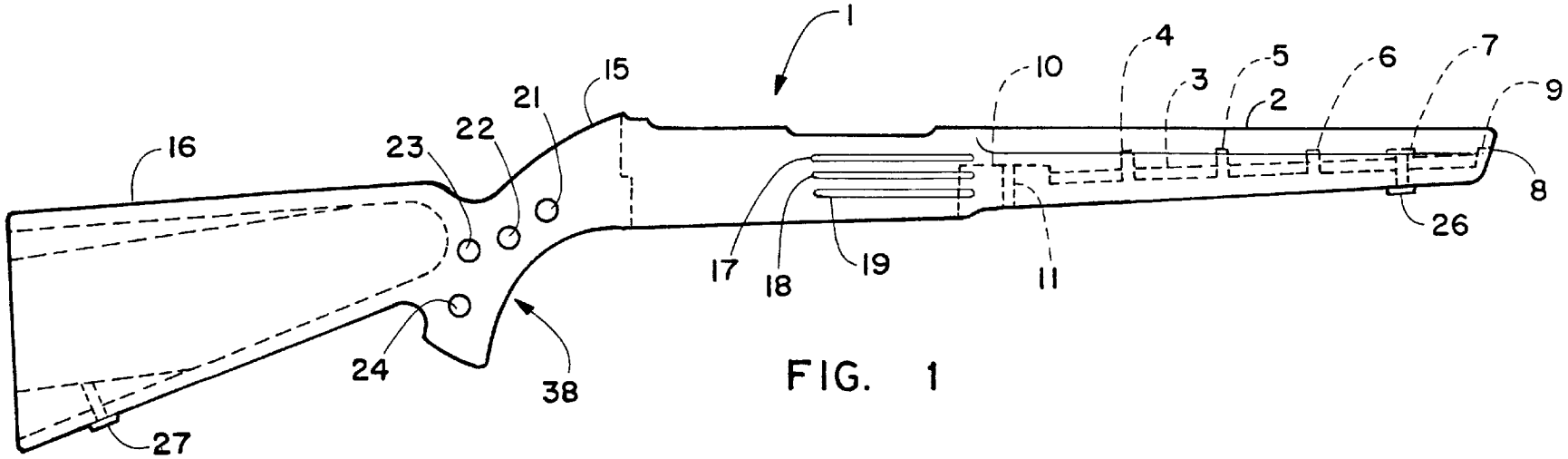
FIG. 1 is a side elevational view of the insert of the present invention.
Figure 2:
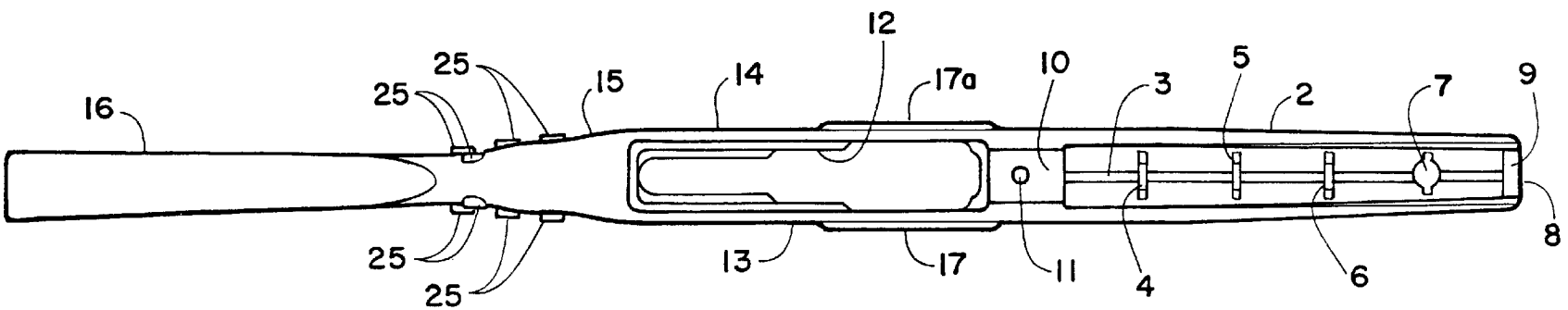
FIG. 2 is a top plan view of the insert of FIG. 1.
Figure 3:
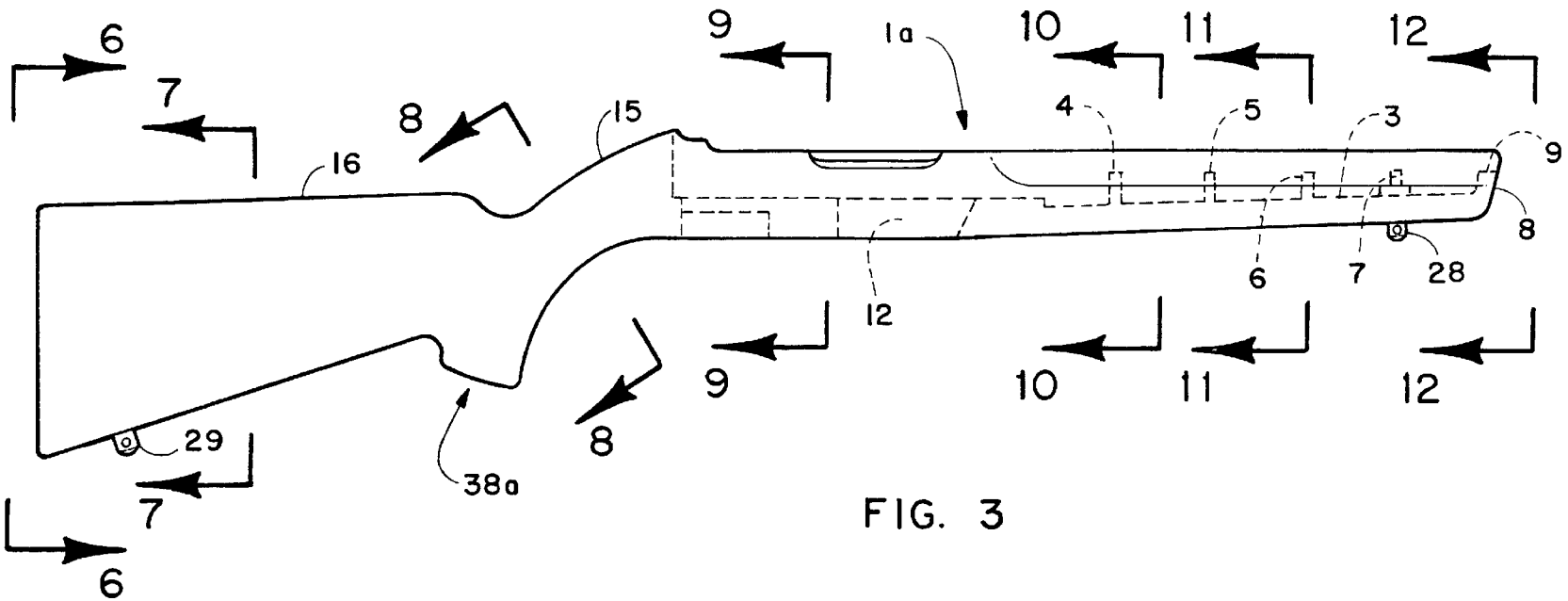
FIG. 3 is a side elevational view of the complete over-molded stock of the present invention.
Figure 4:
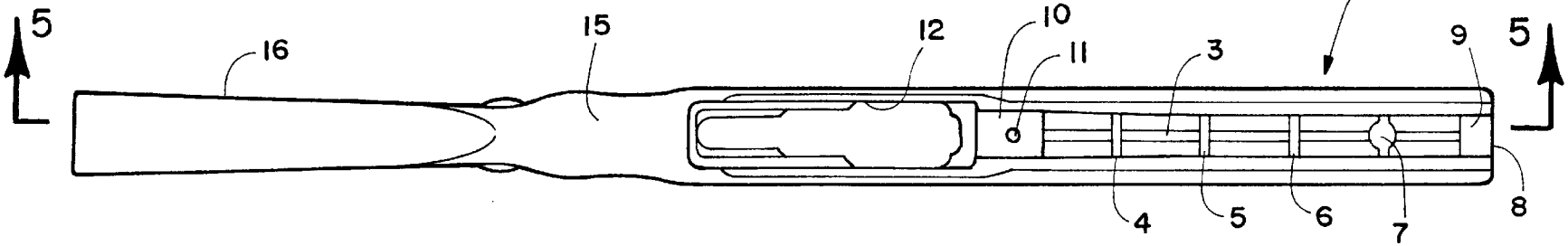
FIG. 4 is a top plan view of the stock of FIG. 3.
Figure 5:
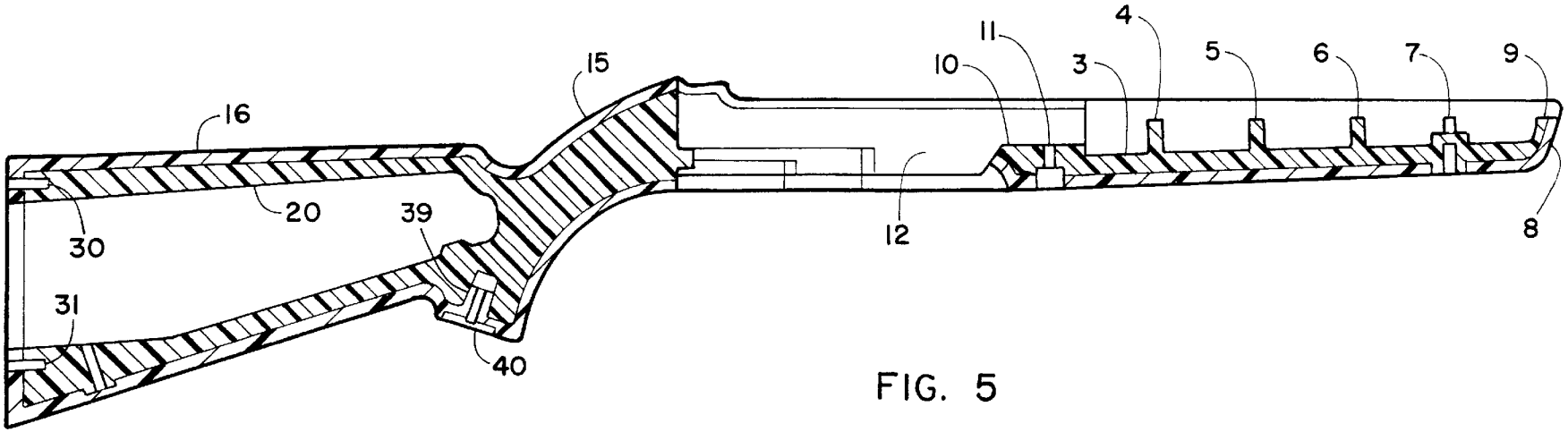
FIG. 5 is a cross-sectional view taken along section line 5—5 of FIG. 4.
Figure 8:
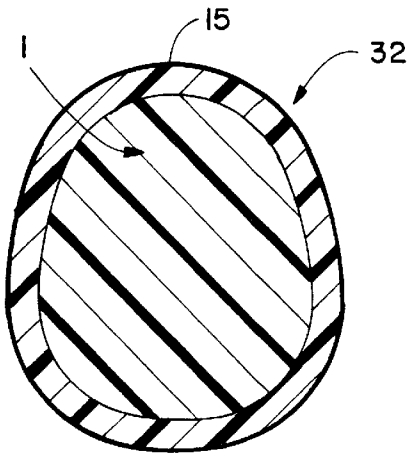
FIG. 8 is a cross-sectional view taken along section line 8—8 of FIG. 3.

The exemplary stock of FIGS. 3 and 4 is made of two major parts, the insert and the over-mold, in two steps. In some embodiments additional major parts may be used such as a bedding block, as will be described hereinafter. In the exemplary embodiment, the first step is the injection molding of the insert. The insert is best shown in FIGS. 1, 2 and 5. The insert extends substantially the length of the finished stock and constitutes the skeleton of the stock. The insert is generally indicated at 1. The forward portion 2 of the insert comprises a substantially channel-shaped portion adapted to receive the rifle barrel. The channel-shaped portion 2 is provided with a longitudinal rib 3 (see also FIG. 10), and a series of transverse ribs 4, 5, 6 and 7. The forwardmost end of insert 1 terminates in an end wall 8 defining a curved notch 9 (see also FIG. 12) through which the rifle barrel extends.

At the rearward end of front portion 2 there is a planar platform 10 with at least one bore 11 extending therethrough. The purpose of bore 11 will be apparent hereinafter.

Rearwardly of interior platform 10 there is an opening 12 defined by a pair of sidewalls 13 and 14. The walls 13 and 14 lead to the thick grip portion 15. It will be understood by one skilled in the art that the opening 12 is adapted to receive the action of the rifle and the interior of the opening 12 will be precisely shaped for that purpose. The grip portion 15 leads to the shoulder abutting stock portion 16.

Insert 1 is preferably molded of a strong, reinforced, synthetic material. Any appropriate synthetic material can be used when a hard un-foamed over-mold material is used. When a thermoplastic elastomer over-mold is used, an olefin base thermoplastic material is preferred for the insert because under these circumstances the over-mold material will bond chemically with the insert material. Excellent results have been achieved, for example, with both types of over-mold when the insert is molded of fiberglass reinforced polypropylene. An example of such material is manufactured by DSM Engineering Plastics, Inc. of Evansville, Ind., and sold under the trademark FIBERFIL® and designated J-60/30/E BK223.

The reinforced synthetic material is combined with an endothermic foaming agent. The foaming agent enables the molding of thick, lightweight portions of the insert without visible "sink" areas, gross warping, or the like.

In addition, the foaming agent helps to minimize or eliminate "joint" and "weld" problems. Welds, for example, are created when portions of molten plastic, traveling in different direction, meet in the mold and solidify. The insert mold must be designed in such a way to overcome this problem so that strong impact resulting from recoil or other forces will not cause a failure in the stock. A preferred way to overcome or minimize flow joints or flow welds is to introduce the material into the mold from one source through a single gate, when possible. On the other hand, the sheer size of the rifle stock, in accordance with conventional molding techniques, would dictate the provision of multiple sources of mold material and multiple gates to guarantee complete fill. Multiple sources and gates, however, potentially cause welds and joints.

In the embodiment illustrated in FIGS. 1 and 2, the joint and weld problems were overcome by using the above-noted endothermic foaming agent which, when activated, becomes solvent-like, thereby lowering the polymer viscosity during the injection molding process for the insert 1. Because of the reduced melt viscosity, a mold could be made with a single gate resulting in the production of stocks free of polymer welds. Rubberized elastomeric hand gun grips are sufficiently small that joint and weld problems are not encountered. With other stock designs multiple gates may be desired or required.

The foaming agent also provides the critical advantage of reducing the inserts overall weight. At the same time, the foaming agent enhances the insert's overall strength by creating essentially a structural "honeycomb" within the insert itself. Excellent results have been achieved with a foaming agent sold by Reedy International of Keyport, N.J., under the trademark SAFOAM® and the designation PE-50. The foaming agent constitutes from 1% to 2% of the synthetic material-foaming agent combination.

The insert is designed to give maximum strength to the finished rifle stock. To this end, the insert is strategically ribbed in critical areas. With respect to the exemplary stock of FIGS. 1 and 2, the forward portion of the insert is provided with a longitudinal rib 3 and transverse ribs 4 through 7. The number of ribs in this area may vary from rifle model to rifle model. The rather thin walls 13 and 14 at the opening 12 which receives the rifle mechanism may also reinforced by ribs. This is shown in FIG. 1 wherein the ribs 17–19 are illustrated on wall 13. It will be understood that the wall 14 is similarly ribbed, one of which is shown at 17*a* in FIG. 2.

Figure 7:
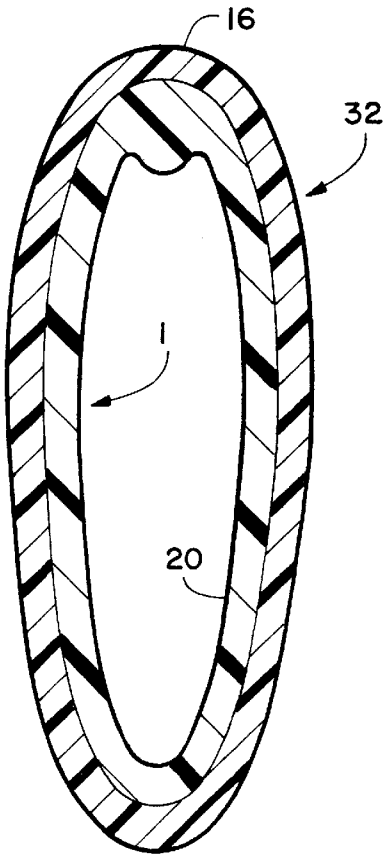
FIG. 7 is a cross-sectional view taken along section line 7—7 of FIG. 3.

In addition, the insert is cored out in critical or thick areas of the insert to reduce warping, excessive swelling or other deformation of the insert. It will be noted, for example, that the shoulder abutting portion 16 of the insert is cored out, as at 20 (see also FIGS. 5, 6 and 7). In addition, the grip portion 15 of the insert often constitutes a rather thick area. In some stock designs, to prevent deformation of this part of the insert, the insert may be provided with transverse holes extending inwardly from both sides toward but not through the middle. Such holes on the right side of the insert are shown in FIG. 1 at 21 through 24. When the molding of insert 1 is completed, the holes 21–24 and their counterparts on the other side of the insert are plugged by cylindrical plugs 25 (see FIG. 2).

Figure 13:
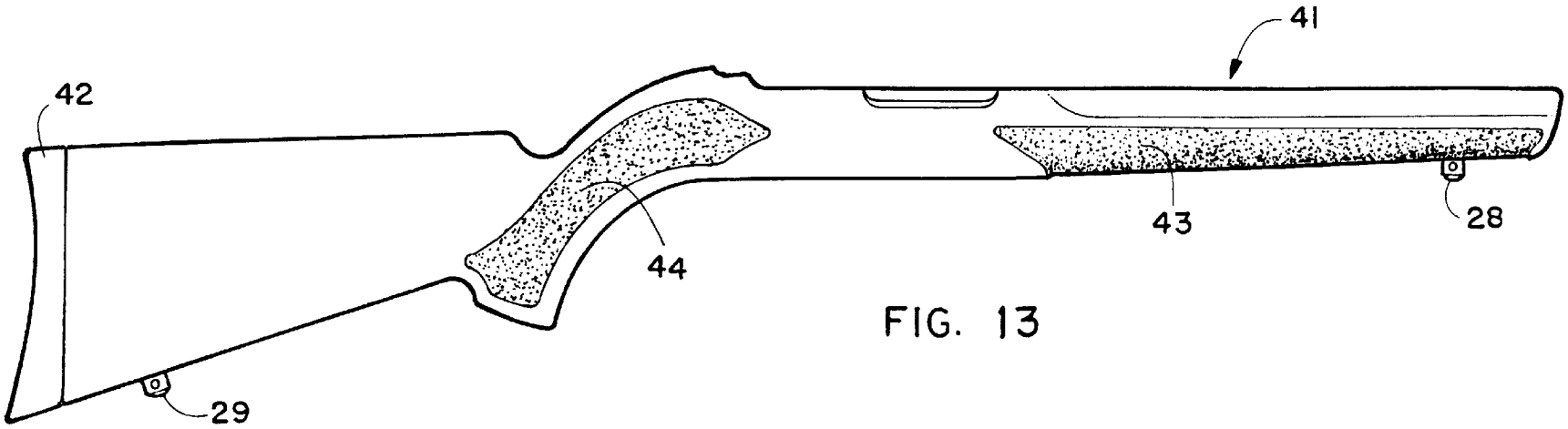
FIG. 13 is a side elevational view of the stock of the present invention illustrating textured areas thereon.

The insert 1 is provided with a protrusion 26 beneath the slightly enlarged transverse rib 7 of the forward insert portion 2. In a similar fashion, a small protrusion 27 is located on the bottom of the shoulder abutting portion 16 of the insert. The mold is configured to provide each of these protrusions with an axial bore. The bores are intended to receive self-tapping sling swivel studs when the stock is completed. Such sling swivel studs are shown in FIGS. 3 and 13 at 28 and 29. The insert is completed by the provision of two more bores 30 and 31 at the rearward end of the stock. These bores are clearly shown in FIGS. 5 and 6. The purpose of these bores will be apparent hereinafter.

As indicated above, the overall insert is precisely dimensioned so that its over-molded areas are smaller than the finished stock. The dimensions are chosen to minimize warpage of the insert and to allow for proper over-molding material flow and bonding.

Once the insert 1 has been molded, the next step is to mount the insert in a final mold and injection mold (over-mold) thereon the thermoplastic elastomer. As indicated above, the thermoplastic elastomer should be chemically compatible with the material from which the insert is molded so that a chemical bond occurs between the reinforced synthetic material of the insert and the thermoplastic elastomer of the over-mold. Excellent results have been achieved, for example, with a thermoplastic elastomer provided by Advanced Elastomer Systems of St. Louis, Mo., under the trademark SANTOPRENE®.

Figure 6:
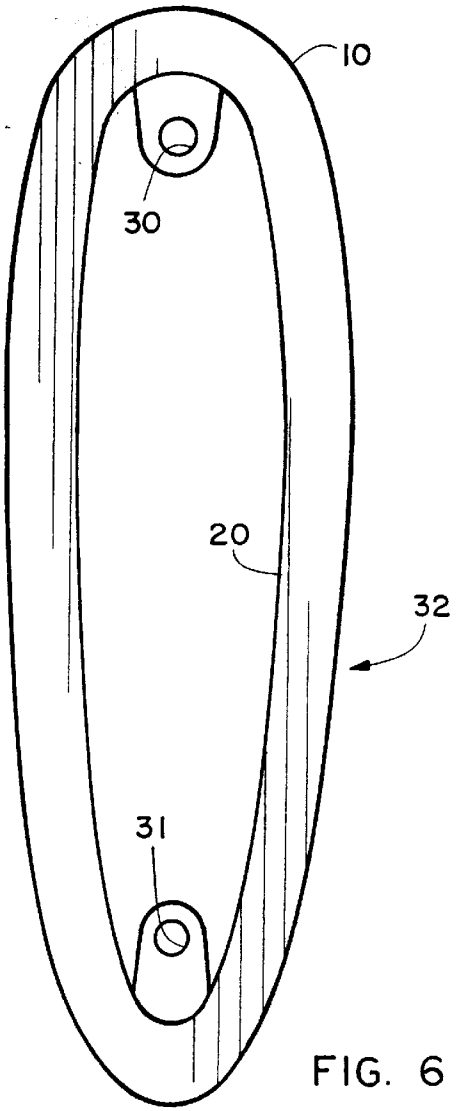
FIG. 6 is a rear end view of the over-molded stock as seen from line 6—6 of FIG. 3.
Figure 11:
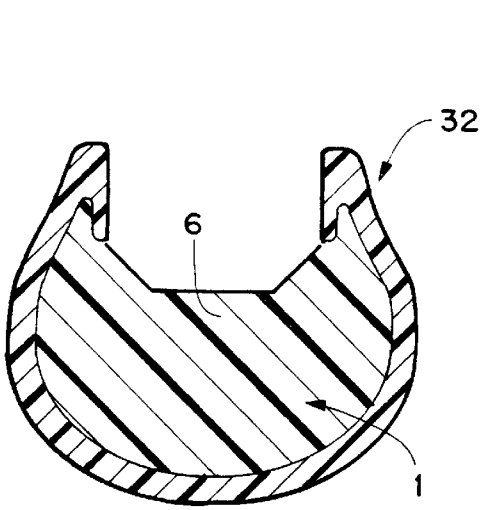
FIG. 11 is a cross-sectional view taken along section line 11—11 of FIG. 3.
Figure 12:
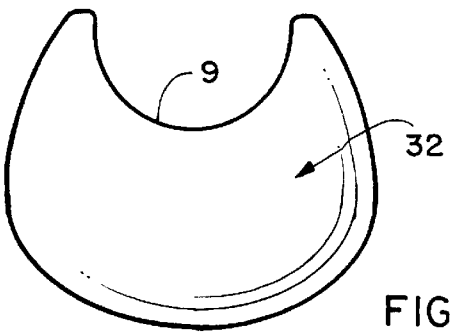
FIG. 12 is a end elevation of the forward end of the stock as viewed from line 12—12 of FIG. 3.
Figure 9:
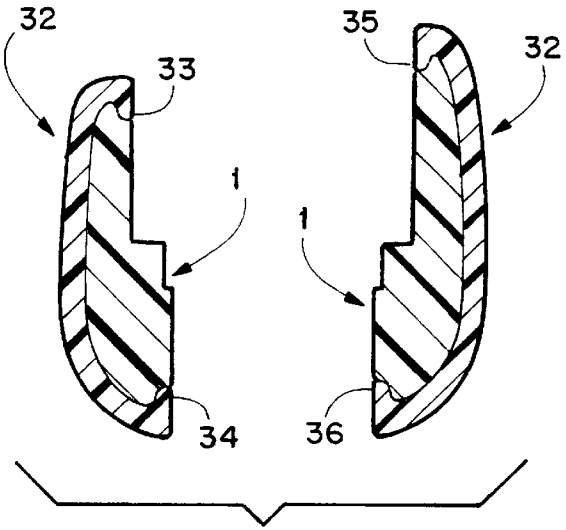
FIG. 9 is a cross-sectional view taken along section line 9—9 of FIG. 3.

The side elevational view of FIG. 3 and the top plan view of FIG. 4 illustrate the over-molded insert, generally indicated at 1*a*. The same is true of the longitudinal cross-sectional view of FIG. 5. FIG. 6 is a rear end view and FIG. 12 is a front end view of the over-molded insert. FIGS. 7, 8, 9, 10 and 11 are cross-sectional views taken along sections lines of the corresponding number in FIG. 3. In these Figures, the thermoplastic rubber over-mold is generally indicated at 32. The rearwardmost end of the stock is over-molded, as clearly shown in FIGS. 5 and 6. Generally, the entire exterior surface of insert 1 is over-molded. Only ribs 3, 4, 5, 6 and 7, the platform 10 and the interior walls of the opening 12 are not over-molded.

Figure 10:
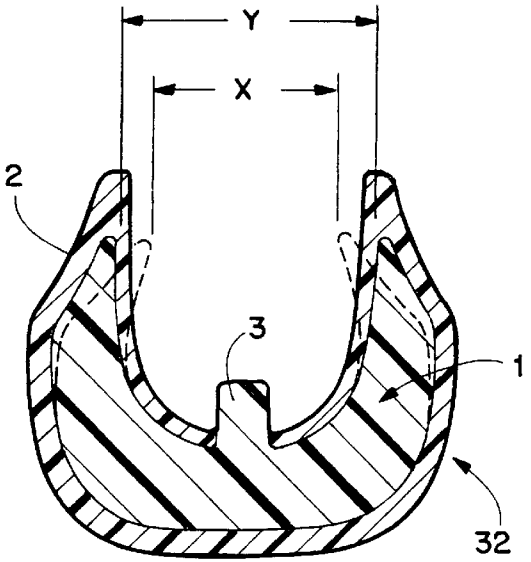
FIG. 10 is a cross-sectional view taken along section line 10—10 of FIG. 3.

It will be understood that distortion considerations due to shrinkage, warpage, outside forces and the like are unique with respect to the over-molded stock. The insert 1 is first molded and minimal shrinkage or warpage may occur and thereafter the insert 1 becomes stabilized. Next, the over-molding places a new thermoplastic material over the already stabilized insert creating stresses not found in single stage molded parts. Reference is made to FIG. 10, for example. The channel of the insert 1 through which the rifle barrel extends is made slightly narrower between the platform 10 and rib 4, between rib 4 and rib 5, between rib 5 and rib 6, between rib 6 and rib 7 and between rib 7 and the end 8. This initial dimension is shown in broken lines and is indicated at "x". When the over-mold material 32 is applied to the insert with appropriate heat and pressure, and then is allowed to cool and stabilize, shrinkage of the thermoplastic rubber will tend to open the channel to the desired dimension "y". It will be understood that the difference between dimensions "x" and "y" in FIG. 10 is exaggerated for purposes of explanation. Since the thermoplastic material of the insert and the thermoplastic rubber are compatible, the materials will chemically bond under the heat and pressure of the injection molding operation.

Again it is desirable to prevent unsightly weld and joint lines in the over-mold material. In the exemplary embodiment of FIGS. 3 and 4, it was possible to introduce the over-mold material into the mold through a single gate. The above-noted ribs 17, 18 and 19, and their counterparts on the other side of the insert are designed and located to minimize the disturbance of the flow of the thermoplastic rubber. At the same time, the flow path of the rubber in the mold must be carefully designed to provide the most efficient rubber-to-insert bonding.

Insert 1 is also designed to provide a mechanical bond, wherever possible, between the thermoplastic rubber and the insert. In areas where delamination would be most likely to occur, such as at thin, fleeting edges of the insert, the insert is configured to cause the thermoplastic rubber to hook thereabout, forming a permanent melt seal. Such permanent melt seals are indicated at 33, 34, 35 and 36 in FIG. 9, which is a cross-sectional view through the walls 13 and 14.

Because of the two-step injection molding process of the present invention, specific rheological analysis was made to ensure compatibility between the two processes and to provide critical data such as linear and transverse shrinkage ratios, as well as the impact of a foaming agent on the structural strength, shrinkage, warpage and weight of the rifle stock.

During the injection molding of the insert 1, the reinforced synthetic material, combined with the foaming agent, was introduced into the mold at a point generally indicated in FIG. 1 at 38. This, of course, created a sprue which had to be removed. The insert 1 was supported in the second mold primarily by means entering the opening 12. Again, a single gate was used, the gate being located at a point generally indicated at 38*a* in FIG. 3. Again, a sprue was created and removed. A bore 39 was formed in the stock and a plug 40, bearing indicia was located in bore 39 (as shown in FIG. 5).

FIG. 13 illustrates the completed stock generally indicated at 41. It will be noted that a butt pad 42 has been added to the rearward end of the stock. The butt pad 42 is affixed to the end of the stock by self-tapping screws (not shown) passing through the butt pad 42 and into the bores 30 and 31 of insert 1.

It is within the scope of the invention to provide selected portions of the surface of the over-molded thermoplastic elastomer with a grip-enhancing texture. The texture may be of any appropriate and well known type. In FIG. 13, side gripping portions of the forward part of the stock and the side gripping portions behind the trigger are shown provided with textured areas 43 and 44, respectively. The textured surface is of the stippled type which enables very firm gripping. At the same time, if the grip is relaxed, the stippled surface portions 43 and 44 allow the hand substantially the same mobility as a smooth stock. It will be understood that stippled areas corresponding to areas 43 and 44 will be located on the other side of rifle stock 41.

As indicated above, a hard, un-foamed material such as nylon can also be used to over-mold the insert. This produces a very hard stock that is lightweight and superior in aesthetic appearance due to the absence of a foaming agent. Nylon will not form a chemical bond with the insert, but will form a mechanical bond. The procedure practiced with a hard, un-foamed over-mold is essentially the same as that practiced with the thermoplastic elastomer except for temperature, pressure and cooling times, determination of which is within the skill of the worker in the art and depends upon the over-mold material used.

As is well-known in the art, for maximum accuracy free floated rifle barrels are generally regarded as the best. In some long guns it is recommended to pressure bed the forward end of the barrel against the surface 9 of the stock. As indicated above, the stock of the present invention can be so constructed as to allow easy adjustment of the barrel bedding for maximum accuracy.

Figure 14:
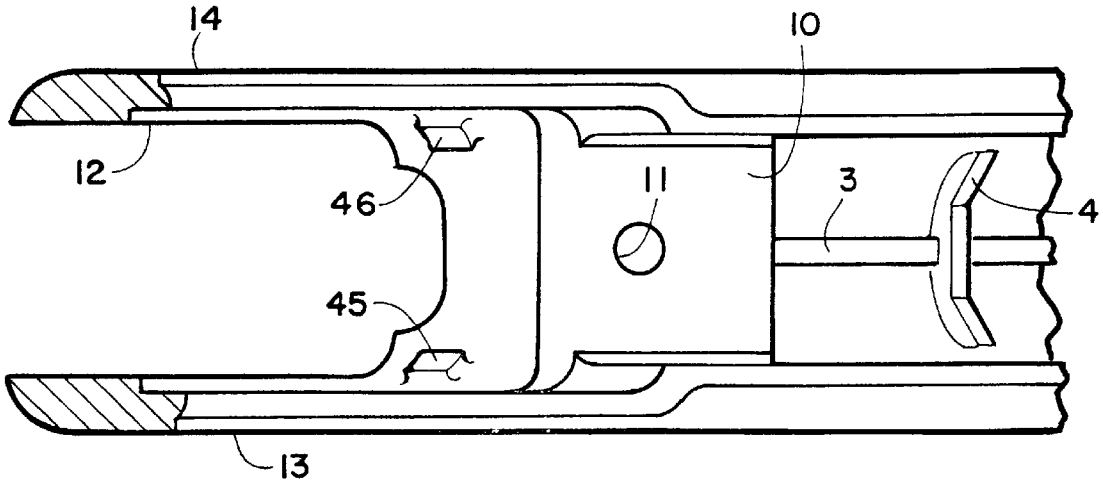
FIG. 14 is a fragmentary plan view of the stock of the present invention illustrating lugs formed on the insert and serving as adjustable contact areas for adjusting the mounting of the barrel in the stock.

To this end, as shown in FIG. 14, the insert 1 may be provided with a pair of upstanding lugs 45 and 46. When the action and barrel of the rifle are installed in the stock, by means of a bolt passing through bore 11, the rifle barrel, at the surface 9 of the stock should be inspected to see if the barrel is free floating or pressure bedded. Less pressure bedding, or free floating if desired, is achieved by filing away some or all of lugs 45 and 46. In an instance where more pressure bedding is required, shimming of lugs 45 and 46 will accomplish this purpose.

Figure 15:
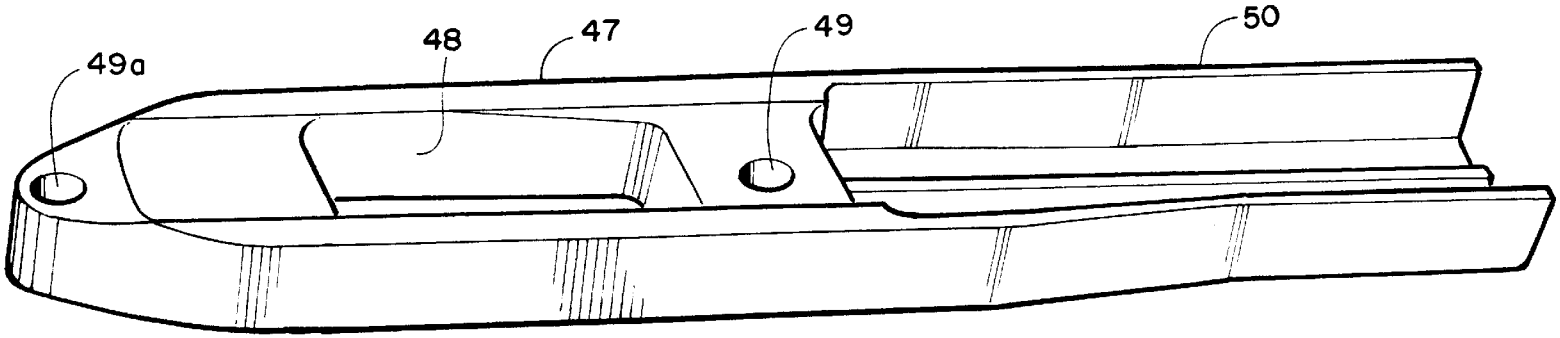
FIG. 15 illustrates a bedding block of the present invention.

For rifles with larger and heavier barrels, usually encountered with center fire rifles, it may be desired to provide the stock with a bedding block. An exemplary bedding block is illustrated in FIG. 15 at 47. The bedding block 47 is provided with an opening 48 corresponding to the opening 12 of FIG. 2, and adapted to receive the rifle action. The bedding block 47 is provided with a perforations 49 and 49*a* through which the action-attaching bolts pass. Bedding block 47 has a forward portion 50 forming the channel through which the barrel passes. Forward bedding block portion 50 may extend partway toward the forward end of the stock, or it may extend all the way to the forward end wall 8 of the stock.

Figure 16:
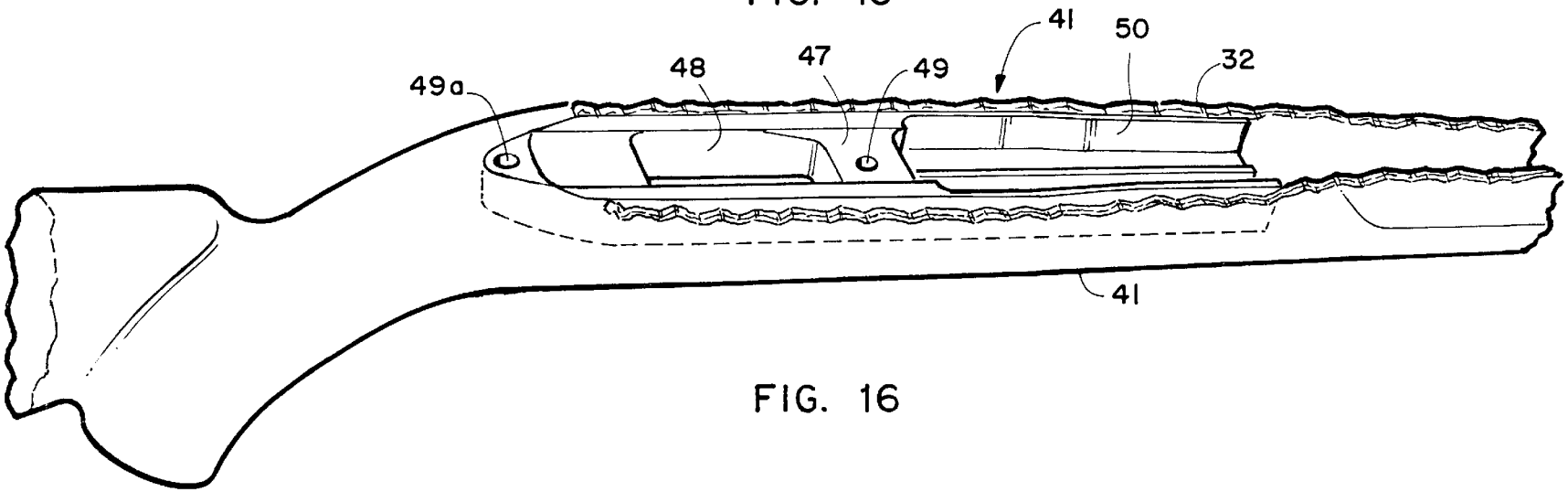
FIG. 16 is a fragmentary view, partly in cross-section, illustrating the bedding block of FIG. 15 mounted within the stock.

When a stock of the present invention is to be provided with a bedding block such as bedding block 47, the bedding block is molded into the insert. The over-mold also incorporates parts of the bedding block. FIG. 16 illustrates a stock 41 of the present invention provided with a bedding block 47. The over-mold 32 is partially cut away so that the bedding block 47 may be easily seen in the Figure. The bedding block 47 may be made of metal, rigid plastic, or any other appropriate rigid material. Excellent results can be achieved with an aluminum bedding block. The bedding block makes the forward end of the stock inflexible and the action is provided with a very solid mount.

Modifications may be made in the invention without departing from the spirit of it.

What is claimed is:

1. A stock for a long gun, said stock comprising a rigid insert injection molded of reinforced synthetic material and a foaming agent, said insert being injection over-molded with an over-mold material;

said stock being a rifle stock; and said stock having a forward portion with a barrel-accommodating channel therein, said stock having a forward end with a notch formed therein aligned with said channel, said channel having a rearward end; said stock having a planar action and barrel mounting platform at said rearward end of said channel, said platform having at least one bore therein to receive a mounting fastener, said stock having an action receiving opening formed therein behind said platform, said stock having a grip portion behind said opening followed by a shoulder engaging butt portion.

2. The stock claimed in claim 1 including a pair of lugs on said insert just behind said platform, whereby by shimming or filing said lugs, rifle barrel adjustment between pressure bedding and free floating can be made.

3. A stock for a long gun, said stock comprising a rigid insert injection molded of reinforced synthetic material and a foaming agent, said insert being injection over-molded with an over-mold material;

said stock being a rifle stock; and said reinforced synthetic material comprising a fiberglass reinforced olefin base thermoplastic, said over-mold material comprising an olefin base thermoplastic elastomer chemically bonded to said insert.

4. A stock for a long gun, said stock comprising a rigid insert injection molded of reinforced synthetic material and a foaming agent, said insert being injection over-molded with an over-mold material;

said stock being a rifle stock; and said reinforced synthetic material comprising fiberglass reinforced polypropylene, said over-mold material comprising an olefin base thermoplastic elastomer chemically bonded to said insert.

5. A stock for a long gun, said stock comprising:

a substantially rigid injection molded stock insert made of a first thermoplastic synthetic material; said injection molded stock insert having a top outer surface, a bottom outer surface, and surrounding side outer surfaces; at least part of said outer surfaces having an injection over-mold layer of a second thermoplastic synthetic material to form a finished long gun stock; said over-mold layer having a substantially non-slip outer surface softer than said outer surface of said stock insert;

said injection molded insert constitutes substantially the bulk and strength of said finished long stock; and said first thermoplastic synthetic material and said second thermoplastic synthetic material being chemically compatible so that a chemical bond occurs between said injection molded stock insert and said over-mold layer due to the heat and pressure of the over-mold process.

6. A stock for a long gun as recited in claim 5 wherein said injection molded stock insert extends substantially the length of the finished stock and constitutes the structural skeleton of said stock.

7. A stock for a long gun as recited in claim 5 wherein said first thermoplastic synthetic material and said second thermoplastic synthetic material each have the same chemical base.

8. A stock for a long gun as recited in claim 5 wherein said first thermoplastic synthetic material includes a reinforcing filler material.

9. A stock for a long gun as recited in claim 8 wherein said first thermoplastic synthetic material further comprises a fiberglass reinforced, olefin base, thermoplastic material.

10. A stock for a long gun as recited in claim 8 wherein said reinforced first thermoplastic synthetic material comprises fiberglass reinforced polyproplene containing a foaming agent, said over-mold layer comprising an olefin base thermoplastic elastomer chemically bonded with said injection molded insert.

11. A stock for a long gun as recited in claim 8 wherein said first thermoplastic synthetic material comprises fiberglass reinforced polyproplene, said over-mold layer comprising an olefin base thermoplastic elastomer chemically bonded to said injection molded stock insert.

12. A stock for a long gun as recited in claim 5 wherein said over-mold layer comprises a thermoplastic elastomer.

13. A stock for a long gun as recited in claim 5 wherein said over-mold layer comprises a thermoplastic elastomer bondable with said injection molded stock insert.

14. A stock for a long gun as recited in claim 5 wherein said over-mold layer comprises an olefin base thermoplastic elastomer.

15. A stock for a long gun as recited in claim 5 wherein a grip enhancing texture is provided in at least selected external areas of said stock.

16. A stock for a long gun as recited in claim 5 further comprising a rigid metal bedding block, said molded stock insert being molded about said bedding block.

* * * * *